United States Patent [19]

Collin et al.

[11] 4,112,693

[45] Sep. 12, 1978

[54] MINE ROOF SUPPORT PLATE

[75] Inventors: Alvaro L. Collin, Orinda; Gordhan M. Patel, Cerritos, both of Calif.

[73] Assignee: Kaiser Steel Corporation, Oakland, Calif.

[21] Appl. No.: 728,254

[22] Filed: Sep. 30, 1976

[51] Int. Cl.[2] ..... E21D 21/00; F16B 29/00

[52] U.S. Cl. ..... 405/132; 85/50 R; 405/259

[58] Field of Search ..... 61/45 B, 39; 85/50 R, 85/79

[56] References Cited

U.S. PATENT DOCUMENTS

| | | | |
|---|---|---|---|
| 2,748,594 | 6/1956 | Edwards | 85/79 |
| 4,037,418 | 7/1977 | Hannan | 61/45 B |

FOREIGN PATENT DOCUMENTS

| | | | |
|---|---|---|---|
| 1,438,536 | 4/1966 | France | 61/45 |
| 405,204 | 7/1966 | Switzerland | 61/45 B |

*Primary Examiner*—Jacob Shapiro

*Attorney, Agent, or Firm*—Naylor, Neal & Uilkema

[57] ABSTRACT

A mine roof support plate having a rigid sheet steel body of uniform thickness wherein a ribbed domed section reinforces the plate against distortion. The domed section is of generally frusto-conical configuration and defines a central section having an opening therein surrounded by a generally planar surface. The periphery of the plate is of planar rectangular configuration and disposed in spaced parallel relationship to the central section. Reinforcing ribs are formed in and extend radially across the domed section to merging intersection with the planar periphery of the plate.

6 Claims, 9 Drawing Figures

MINE ROOF SUPPORT PLATE

BACKGROUND OF THE INVENTION

The present invention relates to mine roof support plates and, more particularly, to a plate of relatively small size adapted to be used within subterranean areas, such as a mine roof. The invention is particularly concerned with such a plate fabricated of stamped sheet steel.

The plate is especially designed for use in mines, tunnels, rock cuts, and other excavations to bind together the various rock strata so as to stabilize the rock formation and prevent its collapse. The plate is intended to be used together with a rock bolt having a conventional bolt anchoring device mounted on its inner end for receipt within a hole bored in the rock to be reinforced. The anchoring device used with the bolt may form a mechanical or chemical anchorage.

The plate of the invention is particularly desirable in that it is of high-strength, lightweight construction and capable of satisfying the requirements of ASTM designation: F 432-76 of the American Society for Testing and Materials. This requires that support plates shall have certain performance deflection characteristics and establishes a test procedure for satisfying these characteristics wherein the plate is first placed over a test plate containing a 4-inch hole and then initially preloaded to 6,000 pounds. Once so preloaded, the load is increased to 15,000 pounds and the bearing plate deflection is measured. The maximum permissible deflection between the 6,000 and 15,000 pound loads is 0.120 inches (3.05 mm.).

The prior art relating to support plates of the type to which the present invention is directed is best exemplified by U.S. Pat. Nos. 3,238,731 and 3,478,523. These patents disclose sheet metal support plates designed to meet a test similar to that of ASTM designation: F 432-76. They are especially concerned with plates having socket-shaped, bolt-receiving recesses designed for use with special bolts having heads with spherical undersurfaces.

U.S. Pat. Nos. 2,748,594; 2,862,368; 3,090,203; 3,163,012; 3,415,064; 3,415,066; and 3,837,258 are also representative of the prior art relating to the present invention. Of these, U.S. Pat. No. 2,748,594 is of particular interest in that it discloses a sheet metal support plate having reinforcing ribs formed therein somewhat like those employed in the plate of the present invention. The plate of the '594 patent is materially different from that of the present invention, however, in that the plate is deliberately designed to deflect upon loading. It is not "rigid" in the same sense as the plate of the present invention and, in all likelihood, could not satisfy the requirements of ASTM designation: F 432-76.

SUMMARY OF THE INVENTION

The rigid sheet steel body of the inventive plate has inner and outer sides and comprises: a generally planar peripheral section; a domed section extending outwardly from and surrounded by the planar section, said domed section intersecting the peripheral section to define a distinct fillet extending around the domed section and merging with the peripheral section; a central section at the outer extremity of the domed section, said central section having a bolt hole extending therethrough and defining a generally flat bearing area extending around the hole and disposed in parallel spaced relationship to the peripheral section; and, a plurality of ribs formed in the domed section so as to extend radially from the central section in angularly spaced relationship to one another. The ribs extend outwardly from the domed section and merge at the distal ends thereof with the peripheral section to provide radial extensions of the fillet between the domed and peripheral sections.

A principal object of the present invention is to provide a relatively lightweight sheet steel mine roof support plate having sufficient rigidity to satisfy the limited deflection requirements of ASTM designation: F 432-76.

Another object of the invention is to provide such a plate adapted to be used with conventional roof bolts.

The foregoing and other objects will become more apparent when viewed in light of the accompanying drawings and following detailed description.

DESCRIPTION OF THE ILLUSTRATED EMBODIMENTS

Figure 1:
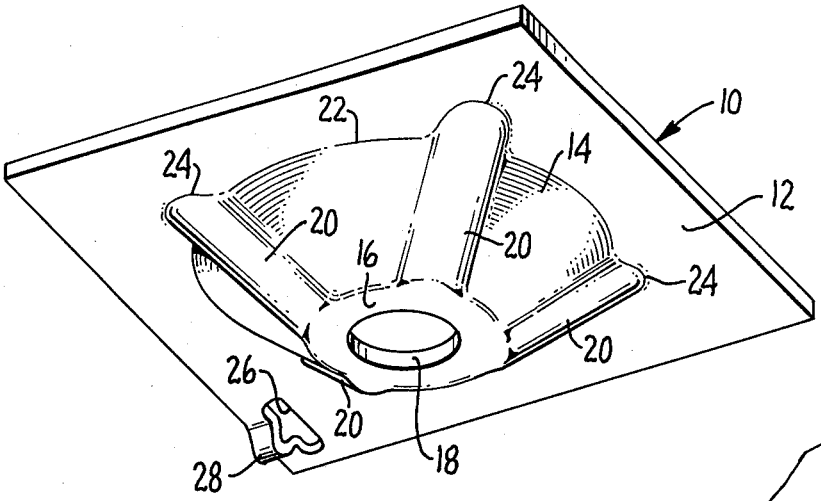
FIG. 1 is a perspective view of a first embodiment of the inventive mine roof support plate, as viewed from the bottom or outer side.
Figure 3:
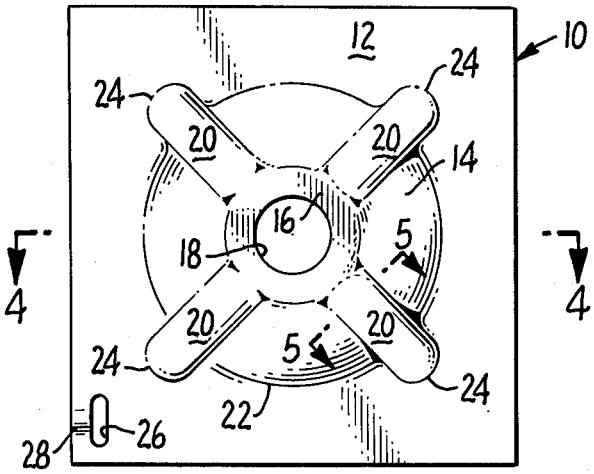
FIG. 3 is a bottom plan view of the first embodiment support plate.

Referring now to FIG. 1, the first embodiment plate shown therein is designated in its entirety by the numeral 10. The plate is fabricated of mild carbon steel, such as SAE 1020, and has a thickness of from about 0.1725 to 0.25 inches. The exact type of steel and thickness may vary, so long as the performance specifications of ASTM designation: F 432-76 are satisfied.

In the preferred embodiment, the plate is cold formed and of rectangular configuration, measuring 6 inches on a side. The depth of the plate, from its bottom to top surfaces, measures approximately 1 inch. The size of the bolt hole in the plate may vary, depending upon the bolt size. For the 6 × 6" plate, the bolt hole size is 1" maximum for a ¾-inch bolt.

The plate 10 has outer and inner sides, the outer side being that viewed in FIG. 1, and comprises: a generally planar peripheral section 12; a domed section 14 extending outwardly from and surrounded by the planar section; a central section 16 at the outer extremity of the domed section, said central section having a bolt hole 18 extending therethrough; and, a plurality of reinforcing ribs 20 formed in the domed section so as to extend radially from the central section in angularly spaced relationship to one another. The domed section 14 intersects the peripheral section 12 to define a distinct fillet 22 extending around the domed section and merging with a peripheral section. The central section 16 is disposed in spaced parallel relationship to the peripheral section 12 and defines a generally annular flat bearing area extending around the hole 18. The ribs 20 extend outwardly from the domed section 14 and merge at the distal ends thereof with the peripheral section 12 to define radial extensions 24 of the fillet 22 between the domed and peripheral sections.

In the first embodiment plate 10, the ribs 20 are four in number and each extend, respectively, toward a corner of the plate. Thus, where the plate is square, the ribs are spaced angularly from one another by 90°.

The structure of the first embodiment plate 10 is completed by a slot 26 and hump 28 disposed to provide an eye for the hanging of lights, etc. Such eyes are conventional in the mine roof support plate art.

Figure 2:
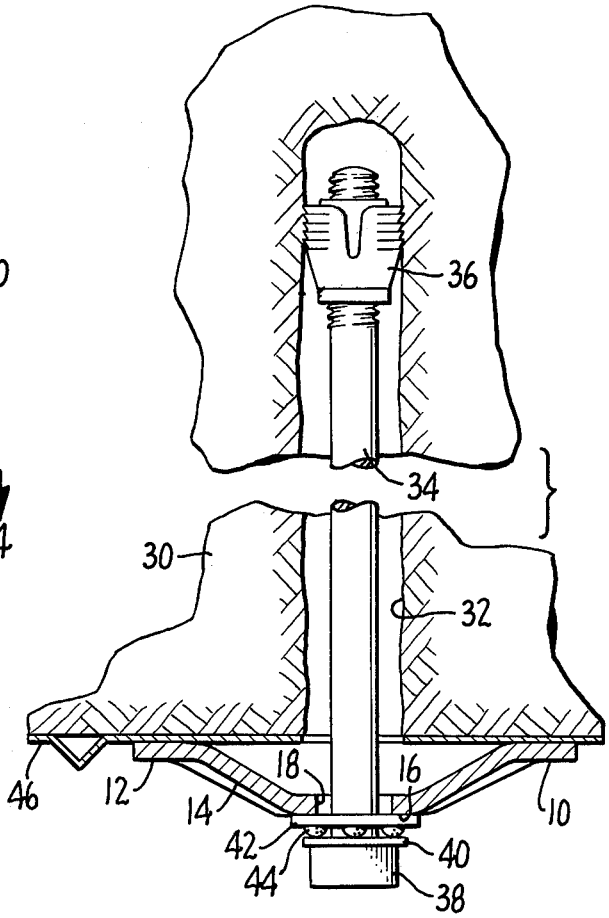
FIG. 2 is a cross-sectional elevational view of the first embodiment support plate installed in supporting relationship to a rock formation.

Referring now to FIG. 2, the first embodiment plate 10 is shown therein as being secured beneath a rock formation 30 having a hole 32 bored therein for receipt of an anchor bolt. Such an anchor bolt, designated 34, is shown received in the hole 32 and mechanically anchored in place through means of an expansible nut 36. The bolt and nut are of conventional construction and the lower end of the bolt has a head 38 integrally formed thereon for engagement by a wrench. A collar 40 is also integrally formed on the bolt.

In the condition illustrated in FIG. 2, the plate 10 is received on the bolt 34 in supporting engagement with the formation 30 and a load-indicating washer 42 is received on the bolt in interposed relationship between the collar 40 of the bolt and the central section 16 of the plate. The washer 42 forms no part of the present invention and is of the type which is adapted to compress to a predetermined degree upon being tightened to the desired extent. Compression is provided through means of bumps 44 formed in the washer and adapted to compress upon being loaded.

FIG. 2 also illustrates a roof mat 46 interposed between the plate 10 and the formation 30. Such mats are conventional in the mine roof support art and are intended to aid in preventing parts of the mine roof from falling away. It should be understood that roof support plates of the type to which the present invention is directed are typically used in large numbers and located at spaced centers. The mat 46 could span the space between the plates.

Figure 4:
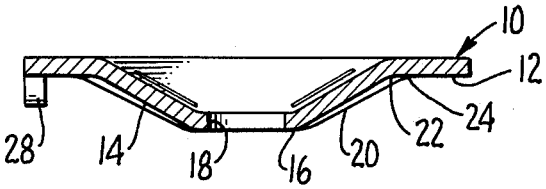
FIGS. 4 and 5 are cross-sectional views taken on the planes designated by Lines 4—4 and 5—5, respectively, of FIG. 3.
Figure 5:
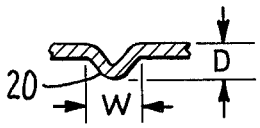

From FIG. 4, it can be seen that the domed section 14 is of generally frusto-conical configuration and, from FIG. 5, it can be seen that the ribs 20 have considerable depth and width. As measured in terms of plate thickness, the width of the ribs, designated "W," in FIG. 1 would be about three times the plate thickness and the depth of the ribs, designated "D," would be approximately twice the plate thickness. With a 6 × 6" plate having a depth of approximately 1", the diameter of the domed section, as measured across the base thereof to diametrically opposed mid-portions of the fillet 22, would be about 4".

Figure 6:
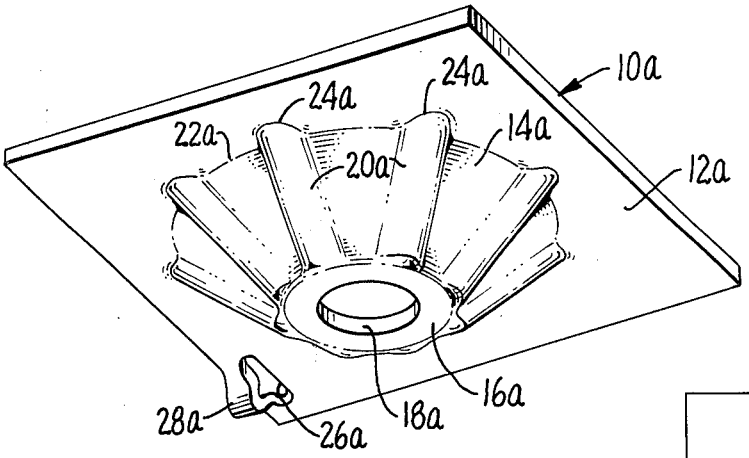
FIG. 6 is a perspective view of a second embodiment of the inventive mine roof support plate, as viewed from the bottom or outer side.
Figure 7:
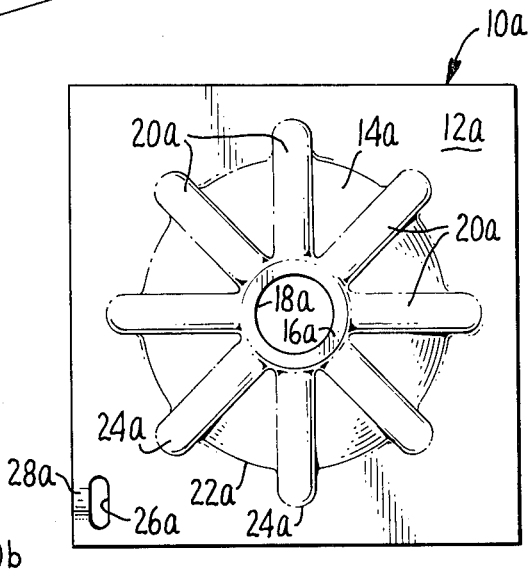
FIG. 7 is a bottom plan view of the second embodiment plate.

The second embodiment plate, illustrated in FIGS. 6 and 7, is identified in its entirety by the numeral **10*a*** and the parts thereof corresponding to those of the first embodiment are designated by like numerals, followed by the subscript *a*. Thus, the elements of the second embodiment plate **10*a* are identified as follows: peripheral section 12*a*; domed section 14*a*; central section 16*a*; bolt hole 18*a*; ribs 20*a*; fillet 22*a*; radial extensions 24*a*; slot 26*a*; and, hump 28*a***.

In the preferred arrangement, the second embodiment plate **10*a* has the same dimensional characteristics as the first embodiment plate 10. The principal difference between the first and second embodiment plates is that the second embodiment plate has eight ribs extending radially from the central section 16*a* in equal angularly spaced relationship to one another. The equal spacing of the ribs means that the ribs are spaced from one another by 45°. The ribs 20*a* are so arranged that four of them extend toward the corners of the plate and the remaining four extend toward the sides of the plate. The ribs 20*a* are all of equal length and, thus, the extensions 24*a*** are of equal length.

Figure 8:
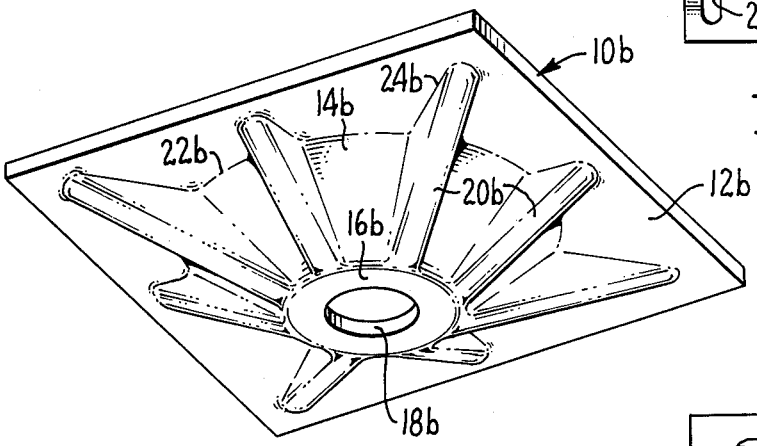
FIG. 8 is a perspective view of a third embodiment of the inventive support plate, as viewed from the bottom or outer side; and, FIG. 9 is a bottom plan view of the third embodiment support plate.
Figure 9:
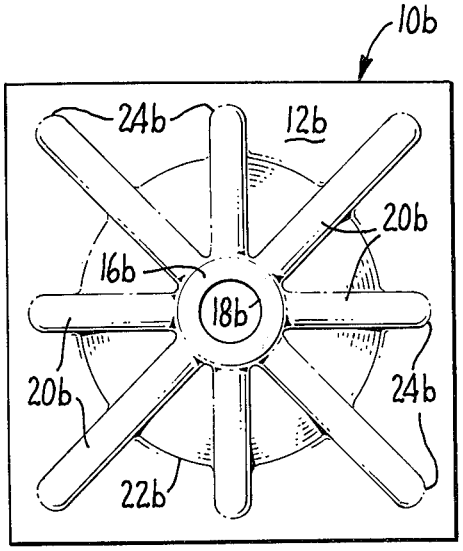

The third embodiment plate, illustrated in FIGS. 8 and 9, is identified in its entirety by the numeral **10*b* and the parts thereof corresponding to those of the first embodiment plate 10** are designated by like numerals, followed by the subscript *b*. Thus, the elements of the third embodiment plate **10*b* are identified as follows: peripheral sections 12*b*; domed section 14*b*; central section 16*b*; bolt hole 18*b*; ribs 20*b*; fillet 22*b*; and, radial extensions 24*b*. The third embodiment plate 10*b* is not provided with an eye-forming slot and hump, such as the slot 26 and hump 28**.

The third embodiment plate **10*b* is similar to the second embodiment plate 10*a* in that it is provided with eight ribs disposed at equally spaced angular intervals. Thus, the ribs 20*b* are spaced from one another by 45°. The plate 10*b* is also similar to the plate 10*a*** in that the ribs are so arranged as to extend toward the corners and sides of the plate.

The third embodiment plate **10*b* differs from the second embodiment plate 10*a* in that the ribs extending toward the corners of the plate 10*b* are longer than those extending toward the side of the plate. This difference can be most easily seen by comparing FIGS. 7 and 9. From FIG. 9, it can be seen that the ribs of the third embodiment 10*b* are so proportioned that the extensions 24*b*** are approximately equally spaced from the sides of the plate.

As with plate **10*a*, the plate 10*b* has the same general dimensional characteristics as the plate 10 and is fabricated of material corresponding to that of the plate 10. In the preferred arrangement, the domed sections 14*a* and 14*b* of the second and third embodiment, respectively, are of a frusto-conical configuration similar to the shape of the section 14 illustrated in FIG. 4**.

CONCLUSION

From the foregoing detailed description, it is believed to be apparent that the present invention enables the attainment of the objects initially set forth herein. It should be understood, however, that the invention is not intended to be limited to the specifics of the illustrated embodiments, but rather is defined by the accompanying claims.

What is claimed is:

1. A mine roof support plate having a rigid sheet steel body of generally uniform thickness, said body having outer and inner sides and comprising: a generally planar peripheral section; a domed section extending outwardly from, and surrounded by, the planar section, said domed section intersecting the peripheral section to define a distinct fillet extending around the domed section and merging with the peripheral section; a central section at the outer extremity of the domed section, said central section having a bolt hole extending therethrough and defining a generally flat bearing area extending around said hole and disposed in parallel spaced relationship to the peripheral section; and a plurality of ribs formed in the domed section so as to extend radially from the central section in angularly spaced relationship to one another, said ribs protruding from the domed section and merging at the distal ends thereof with the peripheral section to define radial extensions of the fillet between the domed and peripheral sections.

2. A mine roof support plate, according to claim 1, wherein the plate is of rectangular configuration, as viewed in plan, and said ribs are four in number and each extend, respectively, toward a corner of the plate.

3. A mine roof support plate, according to claim 1, wherein the plate is of rectangular configuration, as viewed in plan, and said ribs are eight in number and angularly spaced at equal intervals so as to extend, respectively, towards the corners and sides of the plate.

4. A mine roof support plate, according to claim 3, wherein the ribs are all of equal length.

5. A mine roof support plate, according to claim 3, wherein the ribs extending toward the corners of the plate are longer than those extending toward the sides of the plate.

6. A mine roof support plate, according to claim 1, wherein the domed section is of frusto-conical configuration.

* * * * *